United States Patent [19]

Steffes

[11] Patent Number: 4,889,257

[45] Date of Patent: Dec. 26, 1989

[54] CONTAINER WITH MULTIPLE POSITION LID

[75] Inventor: William J. Steffes, Wichita, Kans.

[73] Assignee: Coleman Outdoor Products, Inc., Wichita, Kans.

[21] Appl. No.: 207,714

[22] Filed: Jun. 16, 1988

[51] Int. Cl.[4] ..... B65D 43/14

[52] U.S. Cl. ..... 220/331; 220/212

[58] Field of Search ..... 220/212, 315, 331, 333

[56] References Cited

U.S. PATENT DOCUMENTS 391,145 10/1888 Hardin ..... 220/331 X 2,979,223 4/1961 Rideout ..... 220/331

*Primary Examiner*—John Fox

[57] ABSTRACT

A container includes a container body and a lid. The lid includes a pair of pins which extend into slots in the side walls of the container body. The configurations of the slots and the pins are such that the pins can slide but not rotate in the main portions of the slot but can rotate in enlarged end portions of the slots. The position of the lid can be reversed by positioning the pins in the enlarged end portions of the slots, rotating the lid 180°, and sliding the lid and the pins to the other ends of the slots. The lid can then be opened or closed while the lid is in its inverted position by sliding the pins within the slots.

12 Claims, 2 Drawing Sheets

FIG. 5
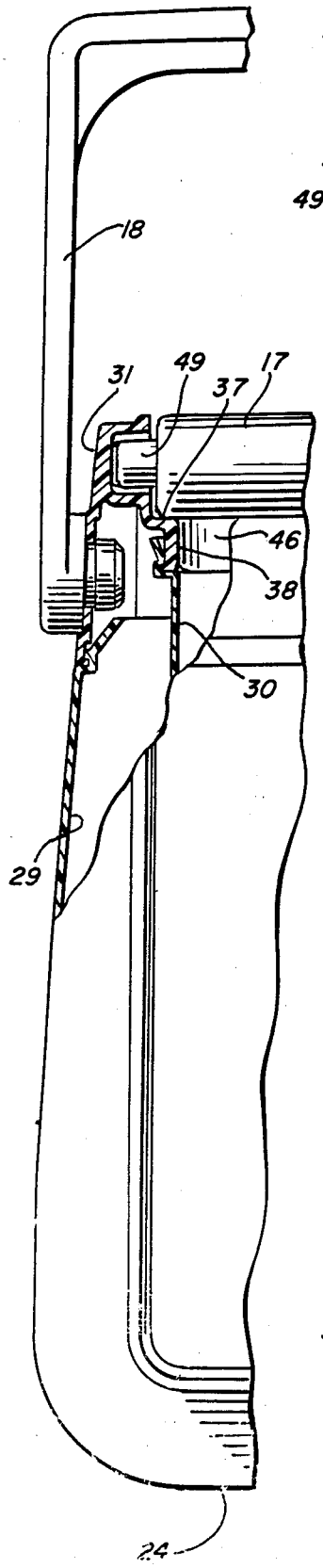
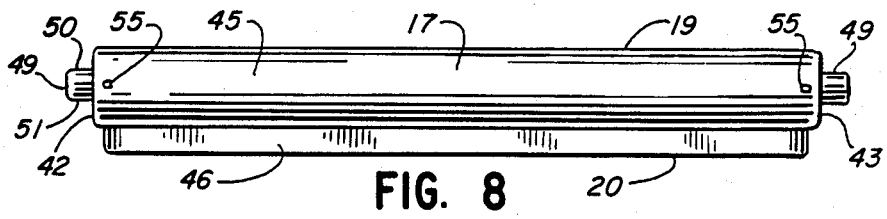
FIG. 8
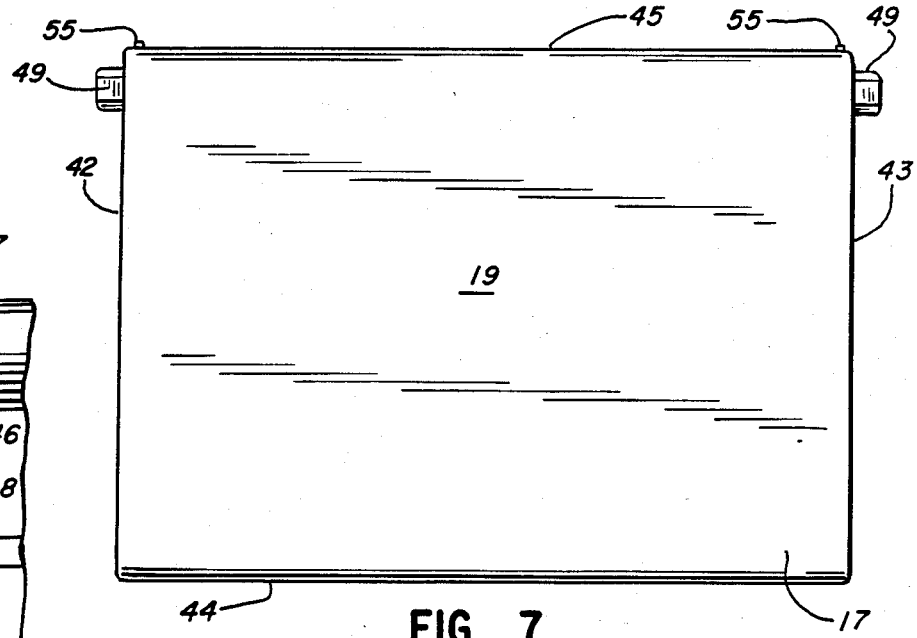
FIG. 7
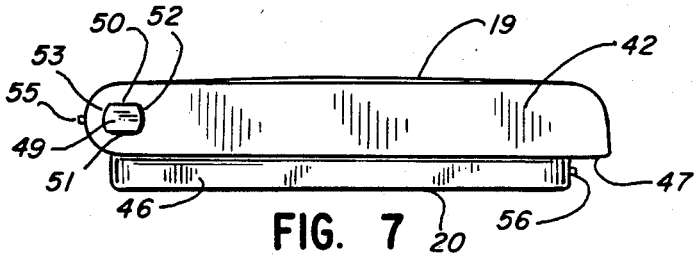
FIG. 7
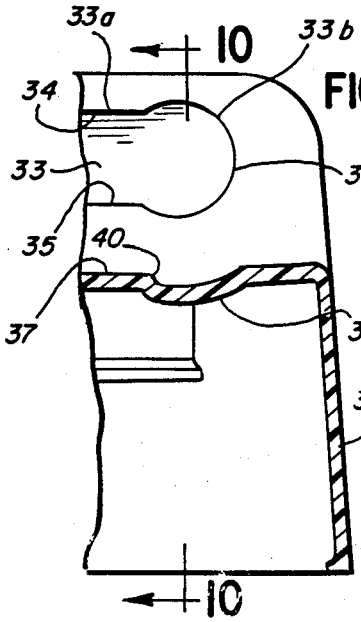
FIG. 9
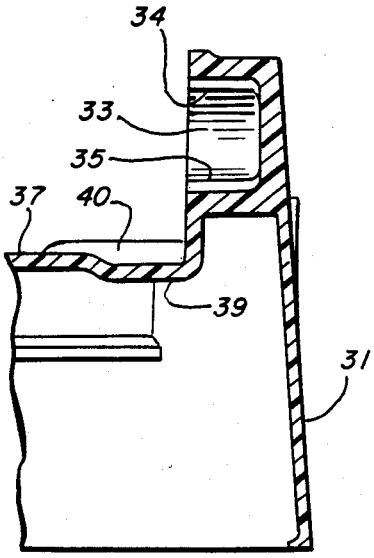
FIG. 10

CONTAINER WITH MULTIPLE POSITION LID

BACKGROUND AND SUMMARY

This invention relates to a container, and, more particularly, to a container with a multiple position, reversible, both hinged and sliding lid. The invention finds particular utility in coolers or ice chests, but it can also be used in other containers such as tool boxes, tackle boxes, etc.

A cooler for storing cold food, beverages, ice, etc. commonly includes an insulated container body and a lid which may but need not be insulated for closing the top of the container. The lids of some coolers are made relatively smooth and flat so the cooler may be used as a seat when the lid is closed. The lids of some other coolers have been provided with a bottom surface having recesses for supporting beverage cans and the like. In one type of cooler the lid is removable from the cooler so that the position of the lid can be reversed. The lid can be supported by the cooler and closes the cooler in either the normal or reverse position. When the lid is reversed, it provides a beverage tray on top of the cooler for holding beverage cans and food. Allowing the lid to be removable, so that it can be reversed, inadvertently allows the lid to be easily lost by the user. In other coolers the lid remains attached to the cooler and is supported in cantilever fashion to expose the bottom surface. However, in that position the lid does not close the container body, and the amount of weight which can be supported by the lid is limited.

The invention provides a reversible lid which remains attached to the cooler and which fully closes the container body in either position of the lid. The lid includes a pair of pins which extend laterally outwardly from the sides of the lid and which are slidably received by a pair of slots in the sides of the container body. At least one end of each slot is enlarged so that the pins can rotate when they are positioned in the enlarged end portions. The lid can be reversed by positioning the pins in the enlarged end portions of the slots, rotating the lid 180°, and sliding the pins to the other ends of the slots. Detents on the lid are engageable with stop shoulders on the container for maintaining the lid in a raised, generally vertical position. When the lid is in its inverted position, it can also be opened and closed, even while beverages or food are placed on it, by sliding it back and forth with its pins retained within the pair of slots.

DESCRIPTION OF THE DRAWING

The invention will be explained in conjunction with an illustrative embodiment shown in the accompanying drawing, in which

FIG. 5 is an enlarged fragmentary sectional view taken along the line 5—5 of FIG. 1;

FIG. 6 is a top plan view of the lid;

FIG. 7 is a side elevational view of the lid;

FIG. 8 is a rear elevational view of the lid;

FIG. 9 is a fragmentary sectional view of the rear end of one of the side walls of the cooler; and Fig. 10 is a fragmentary sectional view taken along the line 10—10 of FIG. 9.

DESCRIPTION OF SPECIFIC EMBODIMENT

Figure 1:
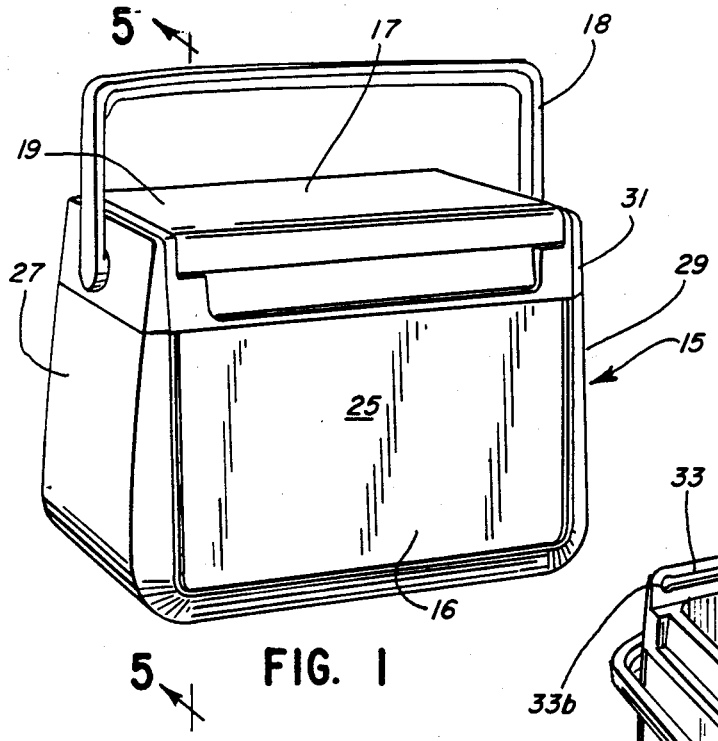
FIG. 1 is a perspective view of a cooler equipped with a multiple position lid in accordance with the invention.

Referring to FIGS. 1–4, the numeral 15 designates generally a cooler which includes a container body 16 and a lid 17. A handle 18 is pivotally attached to the container body for carrying the cooler. The particular cooler illustrated is a personal sized cooler which has a capacity of about 10 to 18 quarts. However, the invention can also be used on larger or smaller picnic coolers, ice chests, lunch boxes, tool boxes, tackle boxes, etc.

The lid 17 includes a flat top surface 19 and a bottom surface 20. The bottom surface is provided with a pair of recesses 21 which are surrounded by curved walls 22.

Figure 4:
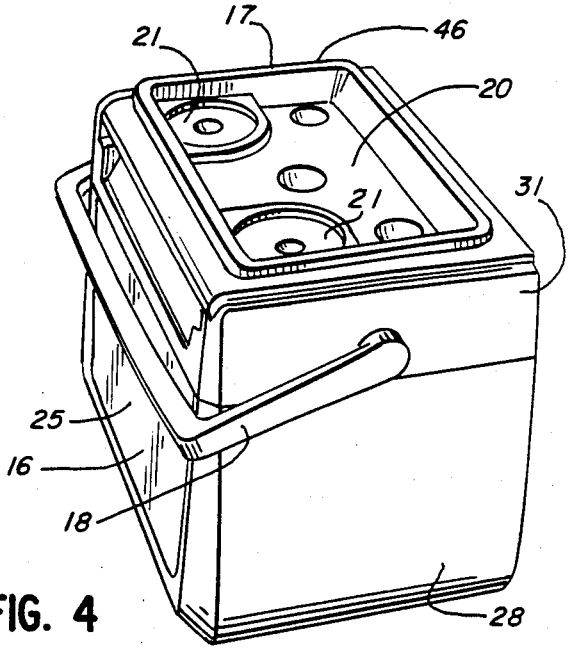
FIG. 4 is a perspective view showing the lid in the reverse position.

When the lid is positioned with the top surface 19 facing upward as shown in FIG. 1, the lid and cooler can be used as a seat. When the lid is reversed so that the bottom surface 20 faces upwardly as shown in FIG. 4, the lid serves as a beverage tray. Beverage cans can be inserted into the recesses 21, and food and other articles can be supported by the remainder of the lid.

The container body is generally rectangular and includes a bottom 24, front and back walls 25 and 26, and side walls 27 and 28. The construction of the container body can be conventional and includes an outer plastic case 29 (FIG. 5) and an inner plastic liner 30. A plastic top ring 31 is attached to the top of the outer case 29 and to the top of the liner 30. The top ring 31 and the liner 30 can also be molded together as one piece. The space inside of the liner and case and top ring is filled with insulating material such as polyurethane foam (not shown).

The top ring 31 is molded to form an elongated slot 33 in each side of the top ring. Each slot includes a main portion **33*a* and a pair of enlarged end portions 33*b*. The main portion is defined by a pair of parallel, flat top and bottom surfaces 34 and 35 (FIGS. 9 and 10). Each of the enlarged end portions is defined by a circular surface 36**.

The top ring 31 extends laterally inwardly below each of the slots to provide a shoulder 37 for supporting the lid. The shoulder 37 extends around the entire periphery of the container, and a rectangular inside wall 38 (FIG. 5) extends downwardly from the shoulder and is attached to the top of the liner 30. Referring to FIGS. 9 and 10, a trough 39 is formed in the shoulder 37 below each of the enlarged ends **33*b* of the slots 33, and a stop shoulder 40** is provided at the forward end of the trough.

Figure 2:
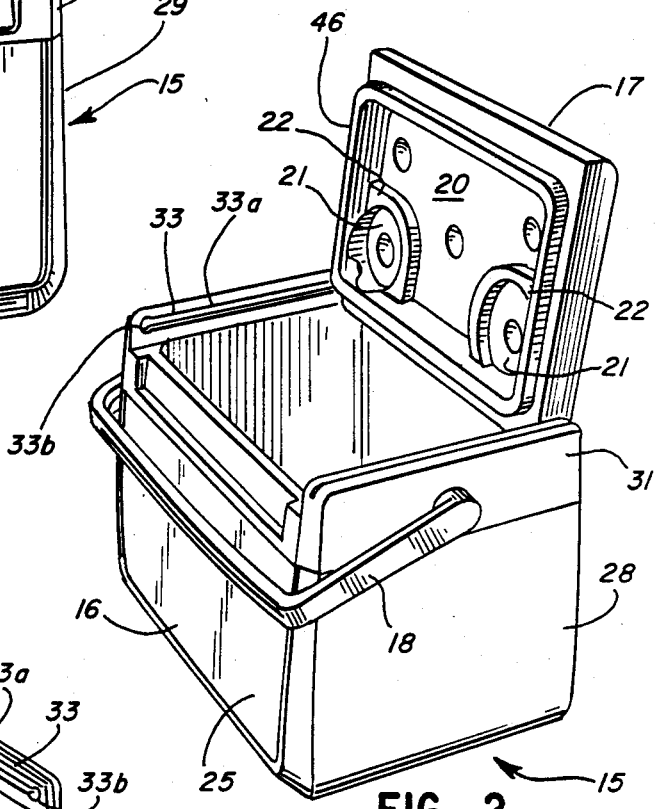
FIG. 2 is a perspective view showing the lid in a raised position.
Figure 3:
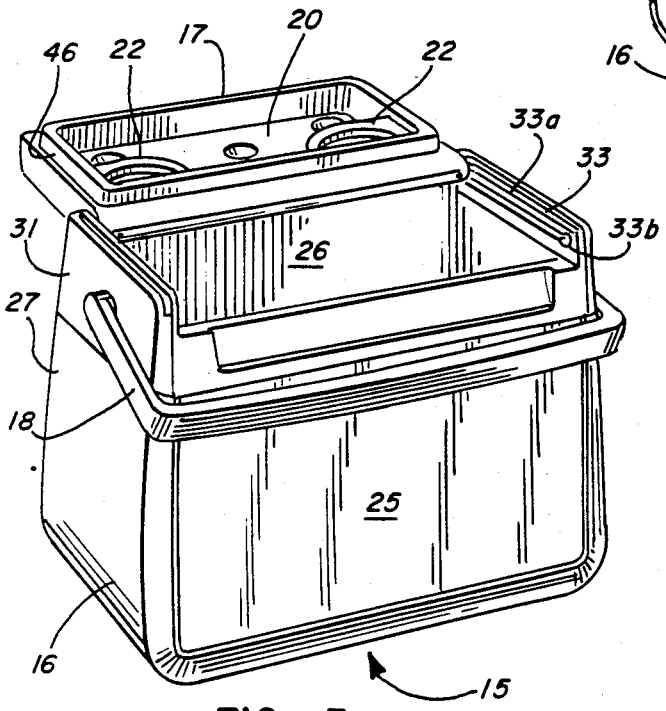
FIG. 3 is a perspective view showing the lid in the process of being reversed.

The lid 17 includes a pair of flat side walls 42 and 43 (FIGS. 6–8) and front and rear walls 44 and 45. Referring to FIGS. 2–4, the beverage tray formed by the bottom surface 20 of the lid is surrounded by a rectangular wall 46 which is spaced inwardly from the front, rear, and side walls of the lid. A shoulder 47 (FIG. 7) extends between the wall 46 and the periphery of the lid.

A support pin 49 extends laterally outwardly from each side of the lid adjacent the back wall 45. Each support pin includes flat top and bottom surfaces 50 and 51 and front and rear curved surfaces 52 and 53 which extend between the flat surfaces. Each of the pins is positioned in one of the slots 33 in the sides of the container body.

The dimension between the flat top and bottom surfaces 50 and 51 of the support pins is just slightly less than the distance between the flat top and bottom surfaces 34 and 35 of the slots. The support pins can therefore slide longitudinally within the main portions 33*a* of the slots but are prevented from rotating by engagement between the flat surfaces. However, when the pins are positioned in the enlarged end portions 33*b* of the slots, the pins can rotate. The radius of the curved walls 36 of the enlarged end portions is slightly greater than the radius of the curved surfaces 52 and 53 of the pins.

A pair of detent pins 55 (FIG. 6) extend rearwardly from the rear surface 45 of the lid. A detent ridge 56 (FIG. 7) extends forwardly from the front of the recessed wall 46.

The support pins 49 of the lid are forceably inserted into the slots 33 of the top ring 31. After the space inside the top ring, case, and liner is filled with foam and the foam cures, the container body is relatively rigid, and the lid is retained on the container body by the support pins.

When the lid is in the normal closed position illustrated in FIG. 1, the lid is supported by the container body and closes the top opening therein. The shoulder 47 (FIG. 7) of the lid is supported by the shoulder 37 (FIG. 5) of the top ring 31. The support pins 49 are positioned in the rear enlarged end portions 33*b* of the slots 33, and the detent ridge 56 (FIG. 7) on the front of the lid engages the inside surface of the liner and frictionally retains the lid in a closed position.

The lid can be opened by rotating the lid upwardly. Rotation of the lid is possible because the support pins are positioned in the enlarged end portions of the slots. The detent pins 55 at the rear of the lid engage the stop shoulders 40 (FIG. 9) after the lid is rotated slightly more than 90°. The lid is thereby retained in an open position illustrated in FIG. 2. When the lid is rotated away from the closed, horizontal position, the support pins 49 are prevented from entering the narrow main portion 33*a* of the slots 33, and the support pins are retained in the enlarged end portions 33*b*.

Since both the detent pins 55 and the stop shoulders 40 are formed from plastic, the pins and shoulders are resiliently deformable to permit the lid to rotate farther if sufficient force is applied. FIG. 3 illustrates the lid after it has been rotated 180°. In that position, the flat surfaces 50 and 51 of the support pins 49 are aligned with the flat surfaces 34 and 35 of the slots 33, and the support pins and the lid can be pushed forwardly as shown in FIG. 4 until the lid completely closes the top of the container body. The smooth surface 19 of the lid is supported by the shoulder 37 of the top ring 31.

When the lid is in the reversed position illustrated in FIG. 4, the bottom surface 20 faces upwardly and serves as a beverage tray. The lid is supported by the container body, and the beverage tray can therefore support a substantial amount of weight. The open top of the container is closed by the lid so that the interior of the container remains insulated.

When the lid is in the FIG. 4 position, the support pins 49 are positioned in the enlarged front end portions 33*b* of the slots 33 which are adjacent the front wall 25. The lid can therefore be pivoted upwardly to open the container. However, the enlarged front end portions of the slots can be omitted if desired. The container can also be opened and closed even when beverages and food are supported by the lid by sliding the lid back and forth. The pins 49 slide within the slots 33.

The lid can be returned to its original position by following the reverse procedure. The lid is moved rearwardly until the support pins are in the enlarged rear end portions of the slots 33. The lid is then pivoted upwardly 180° with sufficient force to move the detent pins 55 past the shoulders 40.

In one specific embodiment of the cooler the outer case 29, the liner 30, and the lid 17 were molded from polyethylene. The top ring 31 was molded from polypropylene.

The shape of the support pins 49 and the slots 33 prevent the lid from pivoting except when the pins are in the enlarged ends of the slots. When the lid is pivoted away from the horizontal position, the pins cannot enter the narrow main portions of the slots. The lid is thereby prevented from rotating about a vertical axis which would allow the pins to swing out of the slots and would allow the lid to be removed from the container.

The advantage of a multiple position lid which are described herein can also be obtained by using simple round support pins and straight slots. However, the lid could then be removed by pivoting the lid upwardly about the axis of the pins and then pivoting or twisting the lid about a vertical axis to swing the support pins out of the slots.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A cooler container comprising a container body having a top opening and a movable lid for opening and closing the top opening, the container body including insulating material and having front and back walls and a pair of side walls, each of the side walls having a slot extending between the front and back walls, the lid having top and bottom surfaces and a pair of side surfaces and a pin extending laterally outwardly from each of the side surfaces, each of the pins extending into one of the slots in the side walls whereby the pins can rotate within the slots so that either the top surface or the bottom surface of the lid can face upwardly from the container body, said container body including handle means for carrying said container.

2. The structure of claim 1 in which the lid and the container body include detent means for retaining the lid in a raised position.

3. The structure of claim 2 in which the detent means comprises a detent on the lid which is engageable with a shoulder on the container body.

4. The structure of claim 2 in which the detent means is resiliently deformable to permit the lid to be moved beyond the raised position.

5. A container comprising a container body having a top opening and a movable lid for opening and closing the top opening, the container body having front and back walls and a pair of side walls each of the side walls having a slot extending between the front and back walls, the lid having top and bottom surfaces and a pair of side surfaces and a pin extending laterally outwardly from each of the side surfaces, each of the pins extending into one of the slots in the side walls whereby the pins can rotate within the slots so that either the top surface or the bottom surface of the lid can face upwardly from the container body, each of the slots including a main portion and an enlarged end portion, the configurations of the main portion of the slots and the pins being such that the pins are slidable but not rotatable in the main portions of the slots, the pins being rotatable when they are positioned within the enlarged end portions of the slots.

6. The structure of claim 5 in which each of the slots includes a pair of enlarged end portions.

7. The structure of claim 5 in which the main portion of each of the slots is provided by a pair of flat spaced-apart surfaces on the container body, each of the pins having a pair of flat surfaces which are engageable with the flat surfaces of the slots to prevent rotation of the pins.

8. The structure of claim 7 in which the enlarged end portion of each slot includes a curved bottom surface and each pin includes a curved surface between the flat surfaces thereof, the curved surfaces of the pins being rotatable relative to the curved bottom surface of the enlarged end portions of the slots.

9. A container comprising:

a container body having a bottom, front and rear walls, and a pair of side walls which provide a top opening, each of the side walls having a slot adjacent the upper end thereof which extends between the front and rear walls, each slot having a main portion provided by flat top and bottom surfaces and an enlarged end portion, a lid for opening and closing the top opening, the lid having top and bottom surfaces and a pair of side surfaces which are positioned inwardly of and adjacent to the side walls of the container body, a pin extending laterally outwardly from each of the side surfaces of the lid into the slot in the adjacent side wall of the container body, each of the pins having a flat surface which is engageable with one of the top and bottom surfaces of the slot when the pin is positioned within the main portion of the slot whereby the pins can slide but not rotate in the main portions of the slots and the pins can rotate in the enlarged end portions of the slots.

10. The structure of claim 9 including a detent on the lid which is engageable with a shoulder on the container body when the pins are rotated within the enlarged end portions of the slots whereby the lid can be maintained in a raised position.

11. The structure of claim 10 in which the detent or the shoulder is resiliently deformable to permit the lid to be moved beyond the raised position.

12. The structure of claim 10 in which the end portion of each slot includes a curved bottom surface and each pin includes a curved surface between the flat surfaces thereof, the curved surfaces of the pins being rotatable relative to the curved bottom surfaces of the enlarged end portions of the slots.

* * * * *